US010527073B2

(12) United States Patent
Martin et al.

(10) Patent No.: US 10,527,073 B2
(45) Date of Patent: Jan. 7, 2020

(54) PRESSURE EXCHANGER AS CHOKE

(71) Applicant: Energy Recovery, Inc., San Leandro, CA (US)

(72) Inventors: Jeremy Grant Martin, Oakland, CA (US); David Deloyd Anderson, Castro Valley, CA (US); Adam Rothschild Hoffman, San Francisco, CA (US)

(73) Assignee: Energy Recovery, Inc., San Leandro, CA (US)

( * ) Notice: Subject to any disclaimer, the term of this patent is extended or adjusted under 35 U.S.C. 154(b) by 43 days.

(21) Appl. No.: 15/614,359

(22) Filed: Jun. 5, 2017

(65) Prior Publication Data

US 2017/0350428 A1 Dec. 7, 2017

Related U.S. Application Data

(60) Provisional application No. 62/346,338, filed on Jun. 6, 2016.

(51) Int. Cl.

| | |
|---|---|
| ***F15D 1/02*** | (2006.01) |
| ***F04F 13/00*** | (2009.01) |
| *F03B 15/02* | (2006.01) |

(52) U.S. Cl.

CPC ..... *F15D 1/02* (2013.01); *F04F 13/00* (2013.01); *F03B 15/02* (2013.01)

(58) Field of Classification Search

CPC ..... F04F 13/00
USPC ..... 417/64
See application file for complete search history.

(56) References Cited

U.S. PATENT DOCUMENTS

| | | | | |
|---|---|---|---|---|
| 3,234,736 | A * | 2/1966 | Spalding | F02C 3/02 417/64 |
| 3,431,747 | A * | 3/1969 | Hashemi | B01D 61/06 417/339 |
| 4,796,595 | A * | 1/1989 | El-Nashar | F02B 33/42 123/559.2 |
| 4,887,942 | A * | 12/1989 | Hauge | F04F 13/00 417/64 |
| 6,540,487 | B2 * | 4/2003 | Polizos | F04B 1/2042 210/652 |
| 7,997,853 | B2 * | 8/2011 | Pique | B01D 61/06 415/90 |
| 2006/0037907 | A1 | 2/2006 | Shumway | |
| 2009/0180903 | A1 * | 7/2009 | Martin | F04F 13/00 417/405 |
| 2011/0008182 | A1 * | 1/2011 | Krogsgard | F04F 13/00 417/63 |
| 2011/0176936 | A1 | 7/2011 | Andrews | |
| 2013/0294944 | A1 * | 11/2013 | Hirosawa | B01D 61/06 417/53 |

(Continued)

FOREIGN PATENT DOCUMENTS

GB 799143 A 8/1958

OTHER PUBLICATIONS

PCT International Search Report & Written Opinion for PCT Application No. PCT/US2017/036170 dated Sep. 4, 2017; 17 Pages.

*Primary Examiner* — Robert K Arundale
(74) *Attorney, Agent, or Firm* — Fletcher Yoder, P.C.

(57) ABSTRACT

A method for using a pressure exchanger to reduce flow as a choke that includes receiving a flow of high pressure fluid at the pressure exchanger, filling a chamber of the pressure exchanger with high pressure fluid, and discharging a portion of the fluid in the chamber at a low pressure.

20 Claims, 8 Drawing Sheets

(56) References Cited

U.S. PATENT DOCUMENTS

| | | | | |
|---|---|---|---|---|
| 2015/0184492 | A1* | 7/2015 | Ghasripoor | E21B 43/26<br>166/250.01 |
| 2016/0032702 | A1 | 2/2016 | Gay et al. | |
| 2016/0040510 | A1* | 2/2016 | Martin | F04F 13/00<br>166/75.11 |
| 2016/0138649 | A1* | 5/2016 | Anderson | E21B 43/16<br>384/107 |
| 2016/0146229 | A1* | 5/2016 | Martin | F04F 13/00<br>92/61 |
| 2016/0160881 | A1* | 6/2016 | Anderson | F04F 13/00<br>415/1 |
| 2016/0281487 | A1* | 9/2016 | Ghasripoor | E21B 43/20 |

* cited by examiner 10
40
42
44
46
48
50
52
54
56
58
60
62
64
66
68
70
72
74
76
78
80
90
92
94
96

PRESSURE EXCHANGER AS CHOKE

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

A choke is a restriction located in a pipeline to limit flow or reduce downstream pressure. Chokes are typically either a fixed orifice choke or a variable orifice choke. For example, the choke may include a variable orifice controlled using a globe valve. Regardless of type, chokes restrict free flow of the fluid within the pipeline. Fixed-orifice chokes can wear out over time. Furthermore, fixed-orifice chokes are not adjustable, and changes in desired flow, changes in fluid properties of the fluid flowing through the pipeline, and/or wear on the choke provides motivation to adjust a choke which is impossible for fixed-orifice chokes. However, adjustable-orifice chokes are more complex and require monitoring. For example, the adjustable-orifice chokes may be monitored using a control systems. Adjustable-orifice chokes also suffer from wear and may also have reduced internal clearances that may clog more easily than fixed-orifice chokes. Both choke types use regular maintenance to ensure that they are working properly and replacement of parts of the choke that are worn.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
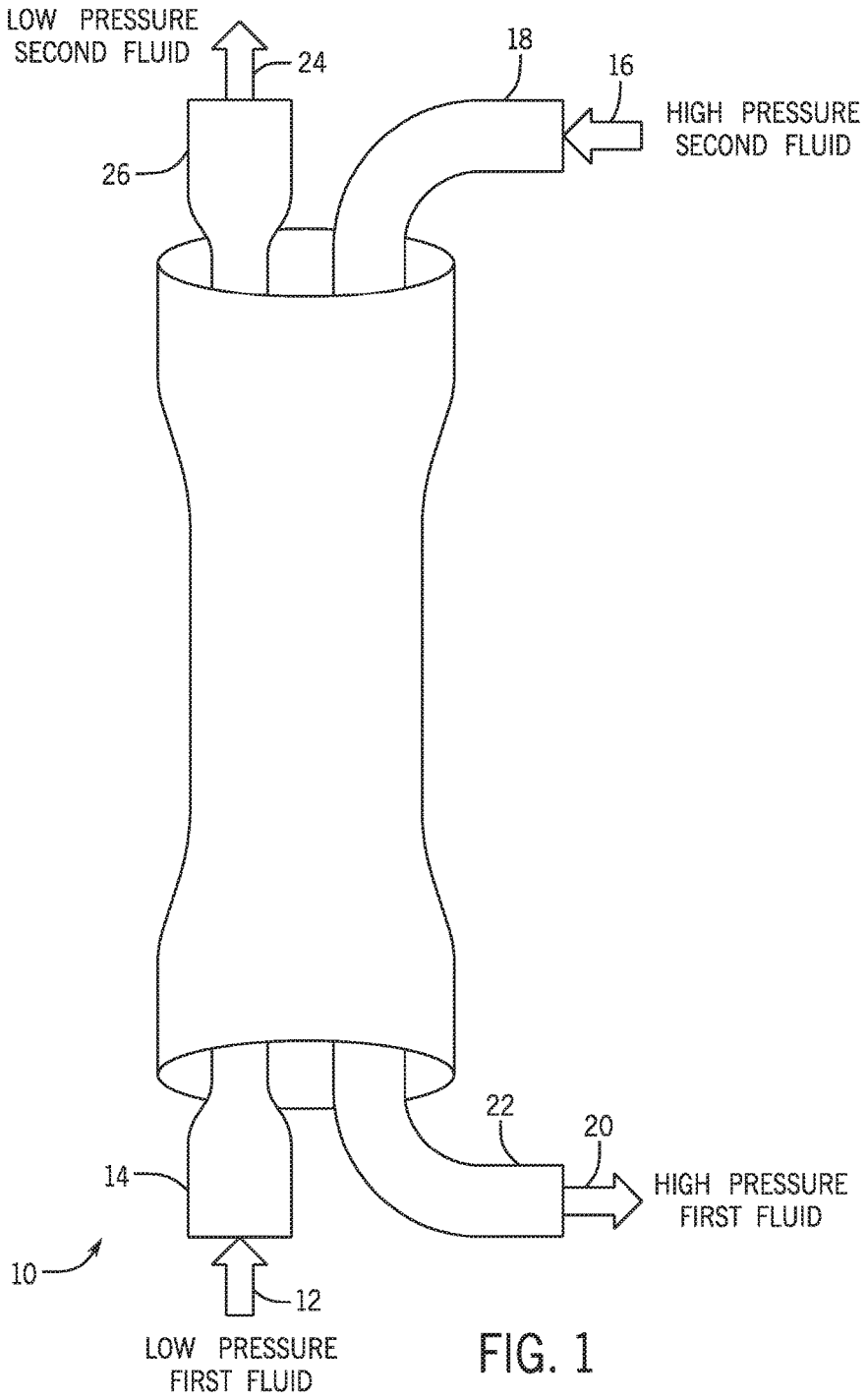
FIG. 1 is a schematic diagram of an embodiment of a system with a pressure exchanger.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

As discussed herein, a pressure exchanger (PX) device is used as a choke based on the inherent flow from a high pressure side to a low pressure side based on the compressibility of the fluid in the chamber. As discussed below, an inlet into the PX may use a high pressure in (HPIN) port and an outlet may use a low pressure out port. In some embodiments, at least one or two ports of the PX may go unused in the choke implementation. As a rotor of the PX turns fluid volume in a chamber of the rotor is compressed by high pressure flow from the HPIN inlet. A portion of the compressed fluid is then discharged in the outlet (e.g., low pressure out) as it expands into the low pressure section. The amount of flow is a function of the volume of the chamber, the number of chambers, the RPM of the rotor of a PX, fluid properties of the fluid being controlled, and differential pressure in the fluid. For example, if the fluid is more compressible, the flow would increase since more fluid is compressed into a chamber each rotation than a lower compressible fluid. Specifically, a gas or a gas/liquid combo would result in an increased flow in relation to a pure liquid flow. The amount of flow also is also dependent upon an amount of pressure in the HP line since higher pressure would compress the fluid more.

As discussed herein, in some embodiments, the pressure exchanger used as a choke may be a rotating isobaric pressure exchanger (e.g., rotary PX). Isobaric pressure exchangers may be generally defined as devices that transfer fluid pressure between a high-pressure inlet stream and a low-pressure inlet stream at efficiencies in excess of approximately 50%, 60%, 70%, 80%, or 90% without utilizing centrifugal technology.

The PX may include one or more chambers (e.g., 1 to 100) to facilitate pressure transfer and equalization of pressures between volumes of first and second fluids. In some embodiments, the pressures of the volumes of first and second fluids may not completely equalize. Thus, in certain embodiments, the PX may operate isobarically, or the PX may operate substantially isobarically (e.g., wherein the pressures equalize within approximately +/−1, 2, 3, 4, 5, 6, 7, 8, 9, or 10 percent of each other). In certain embodiments, a first pressure of a first fluid (e.g., a high pressure energized fluid from the rig or ship) may be greater than a second pressure of a second fluid (e.g., used drilling mud). For example, the first pressure may be between approximately 5,000 kPa to 25,000 kPa, 20,000 kPa to 50,000 kPa, 40,000 kPa to 75,000 kPa, 75,000 kPa to 100,000 kPa or greater than the second pressure. Thus, the PX may be used to transfer pressure from a first fluid (e.g., high pressure energized fluid from the rig or ship) at a higher pressure to a second fluid (e.g., used drilling mud) at a lower pressure.

As explained above, the pressure exchanger in typical operation generally transfers work and/or pressure between first and second fluids. These fluids may be multi-phase fluids such as gas/liquid flows, gas/solid particulate flows, liquid/solid particulate flows, gas/liquid/solid particulate flows, or any other multi-phase flow. Moreover, these fluids may be non-Newtonian fluids (e.g., shear thinning fluid), highly viscous fluids, non-Newtonian fluids containing particles, or highly viscous fluids containing particles. However, some flow may occur from the HP input port to the LP side of the pressure exchanger during pressure transfer. This principle may be used to continue flow from the HP port to a LP port with a reduced pressure inherently acting as choke in the flow of fluid through the pressure exchanger. In some embodiments, the flow may also be reduced versus typical use of the pressure exchanger. For example, in some embodiments, if a dual fluid transfer processes 300 gallons per minute, the flow in a single fluid choke application may be 1 gallon per minute. However, this flow may be adjusted due to speed of the rotation of a rotor of the pressure exchanger. For instance, the pressure exchanger is coupled to an electric motor that controls a speed of rotation of the rotor of the pressure exchanger thereby controlling flow through the pressure exchanger as a variable choke. The speed can also be controlled by controlling a rate of flow through an LP in port to an LP out port, and/or flow through an HP in port to an HPOUT port.

FIG. 1 illustrates an embodiment of a PX 10 that may be used to exchange pressure between two fluid flows. During a pressure exchange operation, the PX 10 receives a low pressure first fluid 12 through a low pressure input (LPIN) port 14 that fills a chamber. The PX 10 also receives a high pressure second fluid 16 through a high pressure input (HPIN) port 18. The high pressure second fluid 16 is used to pressurize the first fluid in the chamber and expel the first fluid from the chamber as a high pressure first fluid 20 from a high pressure output (HPOUT) port 22. Some of the second fluid remains in the chamber after the high pressure first fluid is expelled. The remaining second fluid in the chamber is expelled as a low pressure second fluid 24 via a low pressure output (LPOUT) port 26. During the operation of the PX 10 some fluid inherently flows from the high pressure side to the low pressure side based on compressibility of the fluid in the chamber and/or leakage in the pressure exchanger (e.g., based on clearances between a rotor and an end plate). Such flow may be reduced by increasing stiffness of the rotor and chamber and using more volume in the PX. However, for choke applications, such compressibility and/or leakage may be used to reduce pressure in a fluid received by the PX 10.

Figure 2:
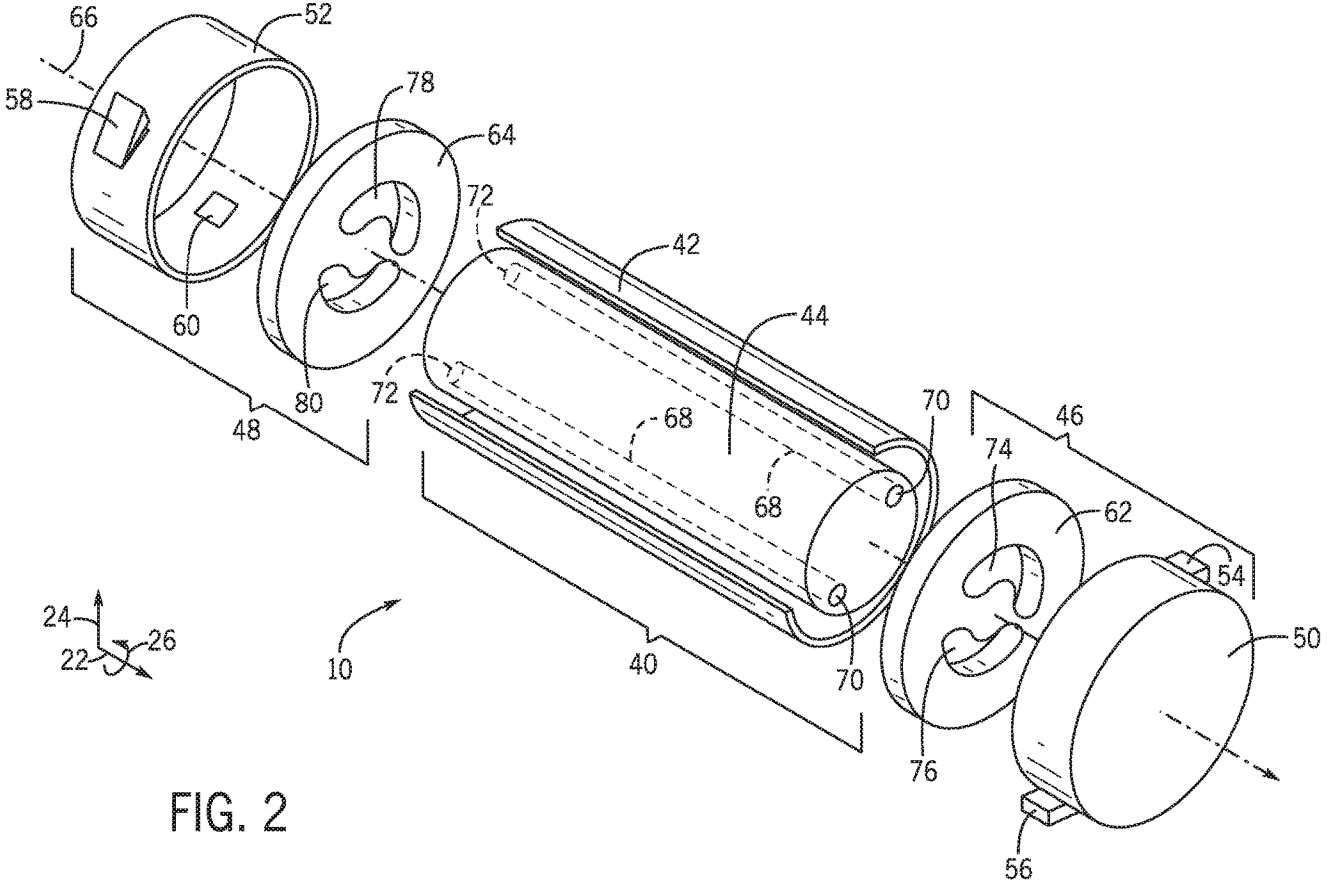
FIG. 2 is an exploded perspective view of an embodiment of a rotary isobaric pressure exchanger (rotary PX)

FIG. 2 is an exploded view of an embodiment of a rotary PX 10 as used to exchange pressures between two fluids. As used herein, the pressure exchanger (PX) may be generally defined as a device that is capable of transferring fluid pressure between a high-pressure inlet stream and a low-pressure inlet stream at efficiencies in excess of approximately 50%, 60%, 70%, or 80% without utilizing centrifugal technology. In this context, high pressure refers to pressures greater than the low pressure. The low-pressure inlet stream of the PX may be pressurized and exit the PX at high pressure (e.g., at a pressure greater than that of the low-pressure inlet stream), and the high-pressure inlet stream may be depressurized and exit the PX at low pressure (e.g., at a pressure less than that of the high-pressure inlet stream). Additionally, the PX may operate with the high-pressure fluid directly applying a force to pressurize the low-pressure fluid, with or without a fluid separator between the fluids. Examples of fluid separators that may be used with the PX include, but are not limited to, pistons, bladders, diaphragms, and the like. In certain embodiments, isobaric pressure exchangers may be rotary devices. Rotary isobaric pressure exchangers (PXs) 20, such as those manufactured by Energy Recovery, Inc. of San Leandro, Calif., may not have any separate valves, since the effective valving action is accomplished internal to the device via the relative motion of a rotor with respect to end covers, as described in detail below with respect to FIGS. 2-6. Rotary PXs may be designed to operate with internal pistons to isolate fluids and transfer pressure with little mixing of the inlet fluid streams. Reciprocating PXs may include a piston moving back and forth in a cylinder for transferring pressure between the fluid streams. Any PX or plurality of PXs may be used in the disclosed embodiments, such as, but not limited to, rotary PXs, reciprocating PXs, or any combination thereof. While the discussion with respect to certain embodiments for measuring the speed of the rotor may refer to rotary PXs, it is understood that any PX or plurality of PXs may be substituted for the rotary PX in any of the disclosed embodiments.

In the illustrated embodiment of FIG. 2, the PX 20 may include a generally cylindrical body portion 40 that includes a housing 42 and a rotor 44. The rotary PX 10 may also include two end structures 46 and 48 that include manifolds 50 and 52, respectively. Manifold 50 includes inlet and outlet ports 54 and 56 and manifold 52 includes inlet and outlet ports 60 and 58. For example, inlet port 54 may receive a high-pressure first fluid and the outlet port 56 may be used to route a low-pressure first fluid away from the PX 10. Similarly, inlet port 60 may receive a low-pressure second fluid and the outlet port 58 may be used to route a high-pressure second fluid away from the PX 10. The end structures 46 and 48 include generally flat end plates 62 and 64, respectively, disposed within the manifolds 50 and 52, respectively, and adapted for liquid sealing contact with the rotor 44. The rotor 44 may be cylindrical and disposed in the housing 42, and is arranged for rotation about a longitudinal axis 66 of the rotor 44. The rotor 44 may have a plurality of chambers 68 extending substantially longitudinally through the rotor 44 with openings 70 and 72 at each end arranged symmetrically about the longitudinal axis 66. The openings 70 and 72 of the rotor 44 are arranged for hydraulic communication with the end plates 62 and 64, and inlet and outlet apertures 74 and 76, and 78 and 80, in such a manner that during rotation they alternately hydraulically expose liquid at high pressure and liquid at low pressure to the respective manifolds 50 and 52. The inlet and outlet ports 54, 56, 58, and 60, of the manifolds 50 and 52 form at least one pair of ports for high-pressure liquid in one end structure 46 or 48, and at least one pair of ports for low-pressure liquid in the opposite end structure, 48 or 46. The end plates 62 and 64, and inlet and outlet apertures 74 and 76, and 78 and 80 are designed with perpendicular flow cross sections in the form of arcs or segments of a circle.

With respect to the PX 10, an operator has control over the extent of mixing between the first and second fluids, which may be used to improve the operability of pressurized or pressurizing systems. For example, varying the proportions of the first and second fluids entering the PX 10 allows the operator to control the amount of fluid mixing within the pressurized or pressurizing systems. Three characteristics of the PX 10 that affect mixing are: the aspect ratio of the rotor chambers 68, the short duration of exposure between the first and second fluids, and the creation of a liquid barrier (e.g., an interface) between the first and second fluids within the rotor chambers 68. First, the rotor chambers 68 are generally long and narrow, which stabilizes the flow within the PX 10. In addition, the first and second fluids may move through the chambers 68 in a plug flow regime with very little axial mixing. Second, in certain embodiments, at a rotor speed of approximately 1200 RPM, the time of contact between the first and second fluids may be less than approximately 0.15 seconds, 0.10 seconds, or 0.05 seconds, which again limits mixing of the streams. Third, a small portion of the rotor chamber 68 is used for the exchange of pressure between the first and second fluids. Therefore, a volume of fluid remains in the chamber 68 as a barrier between the first and second fluids. All these mechanisms may limit mixing within the PX 10.

In addition, because the PX 10 is configured to be exposed to the first and second fluids, certain components of the PX 10 may be made from materials compatible with the components of the first and second fluids. In addition, certain components of the PX 10 may be configured to be physically compatible with other components of the fluid handling system. For example, the ports 54, 56, 58, and 60 may comprise flanged connectors to be compatible with other flanged connectors present in the piping of the fluid handling system. In other embodiments, the ports 54, 56, 58, and 60 may comprise threaded or other types of connectors.

FIGS. 3-6 are exploded views of an embodiment of the rotary PX 10 illustrating the sequence of positions of a single chamber 68 in the rotor 44 as the chamber 68 rotates through a complete cycle, and are useful to an understanding of the rotary PX 10. It is noted that FIGS. 3-6 are simplifications of the rotary PX 10 showing one chamber 68 and the chamber 68 is shown as having a circular cross-sectional shape. In other embodiments, the rotary PX 10 may include a plurality of chambers 68 (e.g., 2 to 100) with different cross-sectional shapes. Thus, FIGS. 3-6 are simplifications for purposes of illustration, and other embodiments of the rotary PX 10 may have configurations different from that shown in FIGS. 3-6. As described in detail below, the rotary PX 10 facilitates a hydraulic exchange of pressure between two liquids by putting them in momentary contact within a rotating chamber. In certain embodiments, this exchange happens at a high speed that results in very high efficiency with very little mixing of the liquids.

Figures 3, 4, 5, 6:
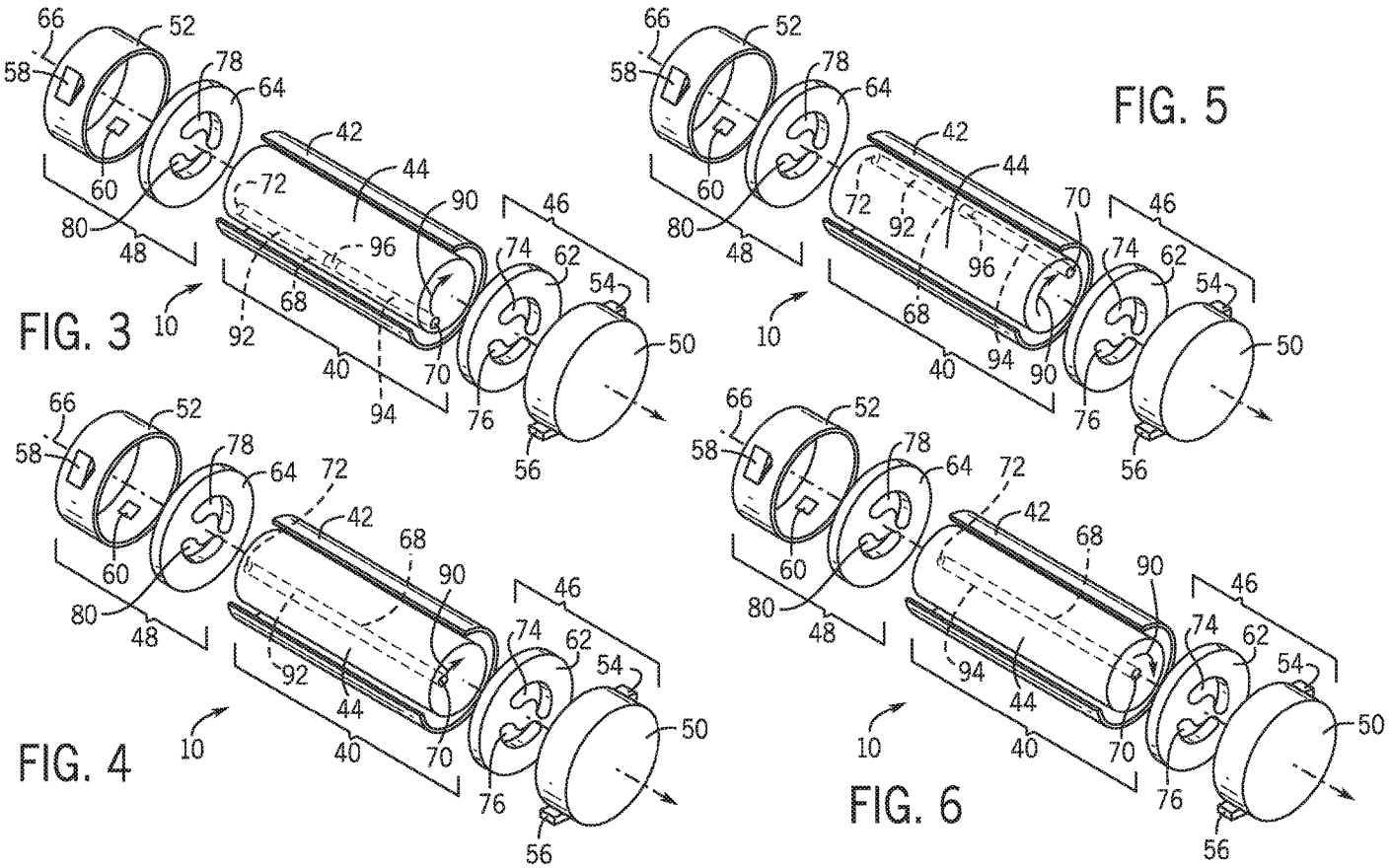
FIG. 3 is an exploded perspective view of an embodiment of a rotary PX in a first operating position.
FIG. 4 is an exploded perspective view of an embodiment of a rotary PX in a second operating position.
FIG. 5 is an exploded perspective view of an embodiment of a rotary PX in a third operating position.
FIG. 6 is an exploded perspective view of an embodiment of a rotary PX in a fourth operating position.

In FIG. 3, the chamber opening 70 is in hydraulic communication with aperture 76 in end plate 62 and therefore with the manifold 50 at a first rotational position of the rotor 44. The opposite chamber opening 72 is in hydraulic communication with the aperture 80 in end plate 64, and thus, in hydraulic communication with manifold 52. As discussed below, the rotor 44 rotates in the clockwise direction indicated by arrow 90. As shown in FIG. 3 low-pressure second fluid 92 passes through end plate 64 and enters the chamber 68, where it pushes first fluid 94 out of the chamber 68 and through end plate 62, thus exiting the rotary PX 10. The first and second fluids 92 and 94 contact one another at an interface 96 where minimal mixing of the liquids occurs because of the short duration of contact. The interface 96 is a direct contact interface because the second fluid 92 directly contacts the first fluid 94.

In FIG. 4, the chamber 68 has rotated clockwise through an arc of approximately 90 degrees, and opening 72 is now blocked off between apertures 78 and 80 of end plate 64, and opening 70 of the chamber 68 is located between the apertures 74 and 76 of end plate 62 and, thus, blocked off from hydraulic communication with the manifold 50 of end structure 46. Thus, the low-pressure second fluid 92 is contained within the chamber 68.

In FIG. 5, the chamber 68 has rotated through approximately 180 degrees of arc from the position shown in FIG. 3. Opening 72 is in hydraulic communication with aperture 78 in end plate 64 and in hydraulic communication with manifold 52, and the opening 70 of the chamber 68 is in hydraulic communication with aperture 74 of end plate 62 and with manifold 50 of end structure 46. The liquid in chamber 68, which was at the pressure of manifold 52 of end structure 48, transfers this pressure to end structure 46 through opening 70 and aperture 74, and comes to the pressure of manifold 50 of end structure 46. Thus, high-pressure first fluid 94 pressurizes and displaces the second fluid 92.

In FIG. 6, the chamber 68 has rotated through approximately 270 degrees of arc from the position shown in FIG. 3, and the openings 70 and 72 of chamber 68 are between apertures 74 and 76 of end plate 62, and between apertures 78 and 80 of end plate 64. Thus, the high-pressure first fluid 94 is contained within the chamber 68. When the chamber 68 rotates through approximately 360 degrees of arc from the position shown in FIG. 5, the second fluid 92 displaces the first fluid 94, restarting the cycle.

In FIG. 6, the chamber 68 has rotated through approximately 270 degrees of arc from the position shown in FIG. 4, and the openings 70 and 72 of chamber 68 are between apertures 74 and 76 of end plate 62, and between apertures 78 and 80 of end plate 64. Thus, the high-pressure first fluid 94 is contained within the chamber 68. When the chamber 68 rotates through approximately 360 degrees of arc from the position shown in FIG. 5, the second fluid 92 displaces the first fluid 94, restarting the cycle.

The PX 10 may be used as a choke without modifying the PX 10 from a configuration used to transfer pressure as discussed above. Instead, flow into and out of certain ports may be blocked. For example, returning to FIG. 2, the ports 56 and 58 may be blocked off to prevent input into and output from the ports 56 and 58. However, any two ports may be used with the remaining ports being unused as blocked and/or ignored. Additionally or alternative, the remaining ports may be flow with a fluid (e.g., an exchange fluid or the same fluid as used in the other ports). A single fluid may be input to a port (e.g., port 54) at a high pressure and output to a different port (e.g., port 60) at a low pressure. This flow may occur due to compression of the fluid in the chamber 68 and/or leakage in the pressure exchanger.

In FIG. 5, the chamber 68 has an opening 70 of the chamber 68 in hydraulic communication with aperture 74 of end plate 62 and with manifold 50 of end structure 46 and port 54. High pressure fluid from the port 54 is loaded into the chamber 68 and at least a portion of the fluid in the port 54 is compressed based at least in part on a compressibility of the fluid therein. As the chamber 68 rotates to the position in FIG. 3, the chamber opening 72 comes into hydraulic communication with the aperture 80 in end plate 64, and thus, in hydraulic communication with manifold 52 and the port 60. The fluid in the chamber 68 decompresses and pushes a portion of the volume of fluid in the chamber into the port 54 as a low pressure fluid.

Figure 11:
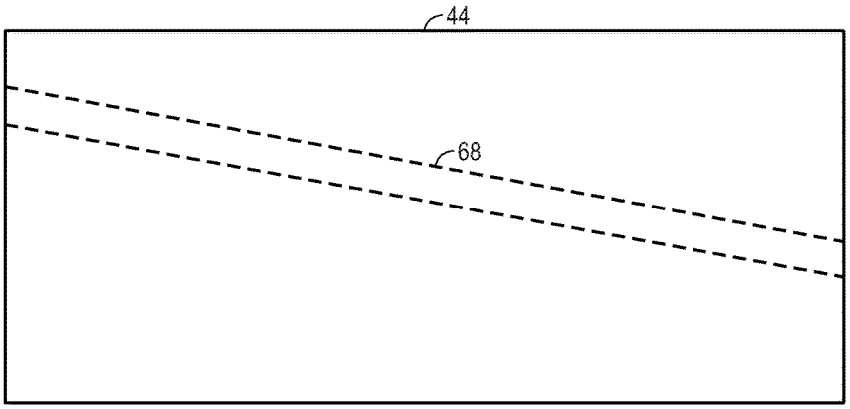
FIG. 11 is an embodiment of a rotor of the choke system having an angled chamber.
Figure 12:
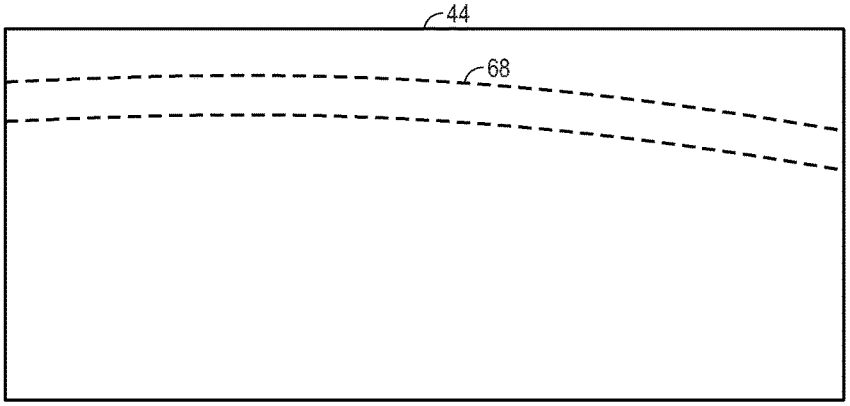
FIG. 12 is an embodiment of a rotor of the choke system having a curved chamber.

This volume may also be supplemented by fluid passing leaking from PX 10 due to clearances between the rotor 44 and the housing 42 or the end plates 62 and 64. The rate of flow may be controlled by an electric, positive displacement hydraulic, or centrifugal turbine machine. Additionally or alternatively, force for rotating the rotor 44 may include momentum transfer on expanding fluid exiting the rotor or dense fluids entering the rotor. Indeed, the chambers 68 in the rotor 44 may be angled (in FIG. 11) and/or curved (in FIG. 12) to increase momentum transfer from the fluid to the rotor 44. In such embodiments, the flow restriction may be fixed for a given pressure differential and fluid properties. Alternatively, in such embodiments, rotor speed may be controlled using alternate paths or braking to slow the rotor. Also, as discussed below, recirculation of flow may provide a motive force for turning the rotor 44.

Figure 7:
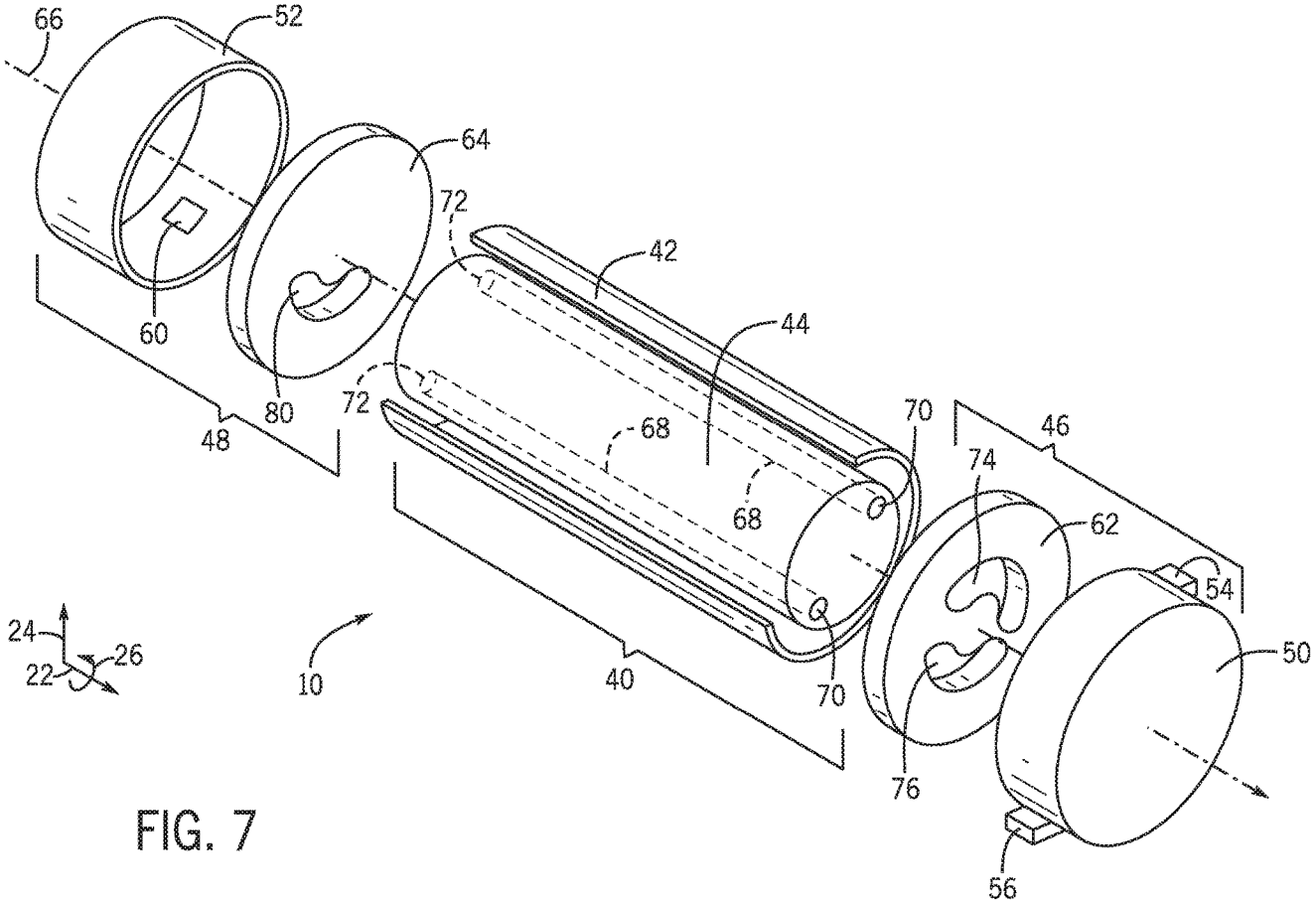
FIG. 7 is an exploded perspective view of an embodiment of a rotary PX in a choke configuration.

Although the PX 10 may be used as a choke without modifying the PX 10 itself, a custom or modified PX may be used. For example, FIG. 7 illustrates a PX 100 that is similar to the PX 10 but the blocked ports are omitted and additional openings in the end plates 62 and 64 are omitted. In some embodiments, the ports 58 and 60 are omitted. In other embodiments, any two ports may be omitted. Furthermore, in some embodiments, the end plates 62 and 64 are not special use parts and are the same in the PX 100 as they are in the PX 10. In other words, the apertures 76 and 78 may not be omitted from the end plates 62 and 64 in the PX 100.

Figure 8:
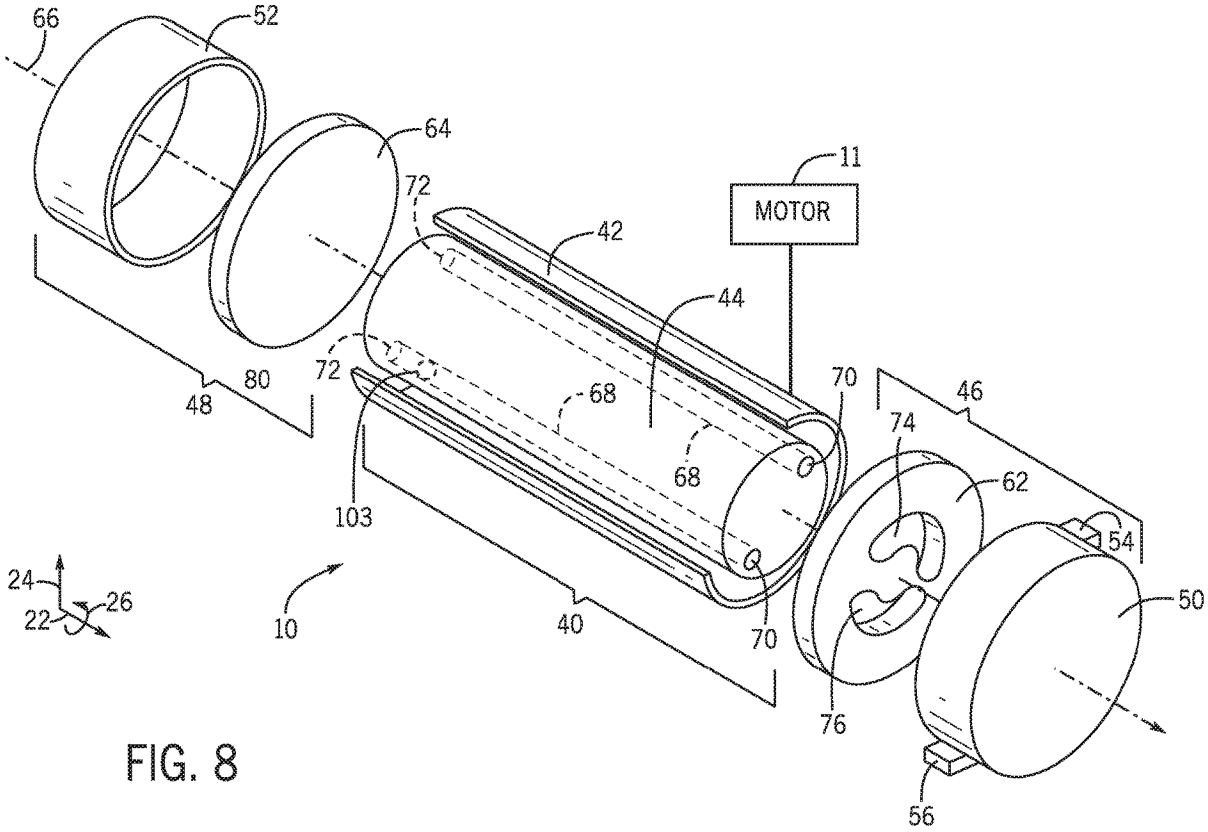
FIG. 8 is an exploded perspective view of a single-sided embodiment of a rotary PX in a choke configuration.

It should be noted that although the port 60 is discussed as an LPIN port in pressure exchange implementations of the PX 10, the port 60 is acting as an LPOUT port in the choke implementation discussed herein. Moreover, any opposing pair of ports may be used in the choke implementation of PX 10 or PX 100. For example, a high pressure port may be paired with a low pressure port rather than with another high pressure port, and a low pressure port may be paired with a high pressure port rather than another low pressure port. Indeed, FIG. 8 illustrates an embodiment of a single-ended PX 102 that selects ports in a common manifold 50 to enable use of a single side of the PX 102 to receive the high pressure input and to output the low pressure output. Moreover, in some embodiments, the end plate 64 has no apertures and the manifold 52 acts as a holder for the end plate 64 urging the end plate 64 against the rotor 44 to block flow from the rotor 44 towards the end plate 64. In some embodiments, the end plate 64 may be omitted, and a port-less "manifold" 52 may be used to block flow from the rotor 44. Furthermore, in some embodiments, the chambers 68 may not extend fully through the rotor 44 and the end plate 64 and the manifold 52 may both be omitted. In other words, the chambers have solid surfaces by omitting the opening 70 from the rotor.

Figure 9:
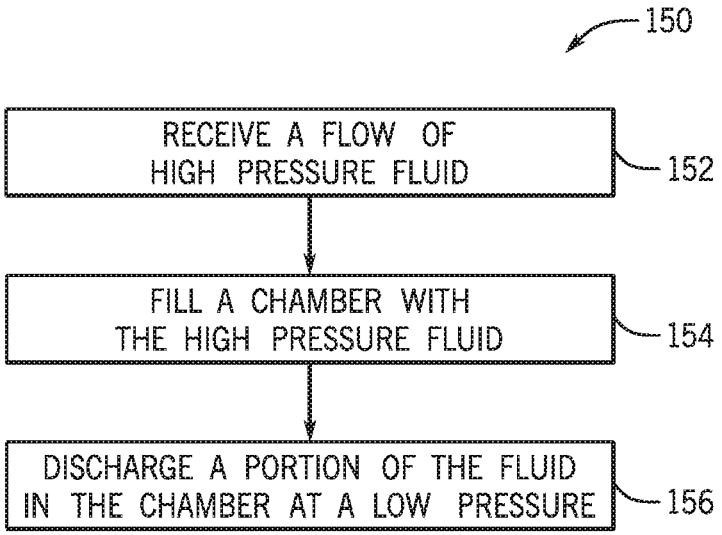
FIG. 9 is an embodiment of a process for using a pressure exchanger as a choke.

Regardless of the embodiment, the PX 10 and 102, when used as a choke, employ a process 150 as illustrated in FIG. 9. The PX receives a flow of a high pressure fluid (block 152). The high pressure fluid fills a chamber of a rotor of the PX (block 154). When filling the chamber, fluid with in the chamber compresses due to the pressure of the high pressure fluid. In some embodiments, the chamber may also expand due to a level of elasticity of the material forming the chamber. Additionally or alternatively, elastic objects 103 (e.g., rubber ball), as illustrated in FIG. 8, may be added to the chamber to emulate or enhance compressibility of the fluid. In other words, when pressurized fluid enters into the chamber, the elastic object compresses and decompresses when the rotor rotates to another port providing impetus for the fluid to exit the chamber post-rotation. During rotation of the rotor, the chamber lines up an opening with an output port. A portion of the fluid filling the chamber is discharged through the output port at a lower pressure (block 156).

As noted previously, the amount of flow is a function of the volume of the chamber, the number of chambers in the rotor, the RPM of the rotor of a PX, fluid properties of the fluid being controlled, and differential pressure in the fluid. For example, if the fluid is more compressible, the flow would increase since more fluid is compressed into a chamber each rotation than a lower compressible fluid. Specifically, a gas or a gas/liquid combo would result in an increased flow in relation to a pure liquid flow. The amount of flow also is also dependent upon an amount of pressure in the HP line since higher pressure would compress the fluid more. Also, to achieve more flow, a PX may be formed of a more elastic material or increase clearances between the rotor and end plates. Additionally or alternatively, additional components may be added to the rotor chambers to in. As previously noted, the RPM of the rotor 44 may be controlled using a motor 11 (e.g., as illustrated in FIG. 8) that is hydraulic, electrically, or combustively driven. Additionally or alternatively, shockwaves may be timed with incoming and outgoing port openings to increase throughput as a wave rotor supercharger.

Figure 10:
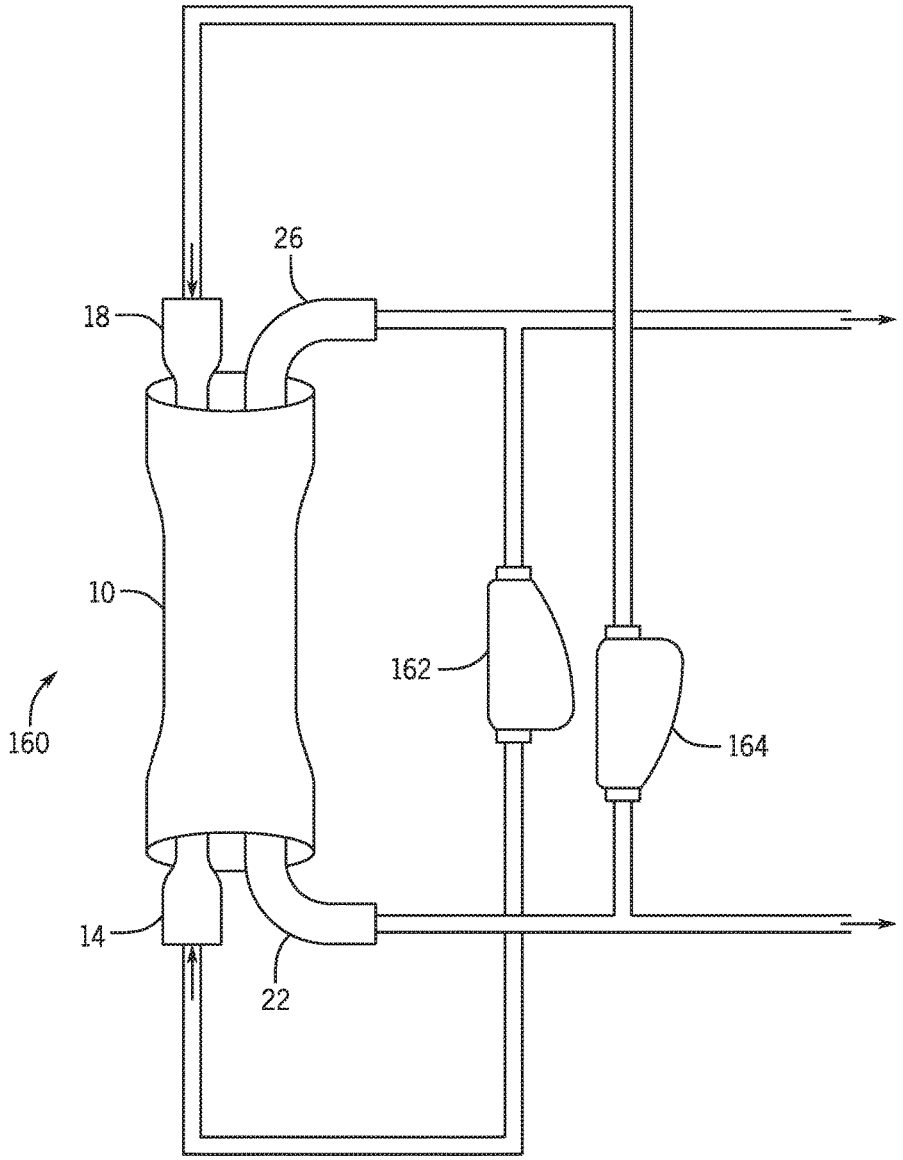
FIG. 10 is an embodiment a choke system having flow control using fluid recirculation.

As another way of controlling flow of the PX may be using recirculation of fluids into the PX. For example, FIG. 10 illustrates an embodiment of a choke system 160 that includes the PX 10 that utilizes recirculation of HP and LP flow to control flow using circulation pumps 162 and 164 that urges flow through LP line 166 and HP line 168, respectively. A portion of the fluid in the LP line 166 and the HP line 168 are recirculated through the PX 10 and another portion is output. In some embodiments, one recirculation pump may be omitted relying on the other pump for flow control through the PX 10.

As can be appreciated, chokes are abundant in numerous implementations, such a oil and gas drilling (e.g., depressurization of used pressurized mud returning from a wellbore), wellhead chokes for oil or gas mixtures exiting a well, off-shore and on-shore processing, refineries, chemical processing plants, refrigeration, gas compression, and gas liquification. Specifically, the choke may replace level control valves, flow control valves, pipeline chokes, and other valves that may be used to restrict fluid flow. The PX as choke may reduce damage from flashing or cavitation is common in standard chokes; may address critical flow choke systems with varying gas-oil ratios better than typical choke systems; may increase flow stability with slugs of liquid or gas; and reduce amounts of shear, turbulence, and cavitation to the fluid that may result in undesirable homogenization of fluids, breaking of long chain molecules, or other undesired changes to the fluid being flowed. Also, the PX enables variable flow flexibility (e.g., using a motor) without the drawbacks of typical choke valves. Since the rotor system of the PX is less likely to use maintenance than typical choke valves, the PX choke may utilize less monitoring and be replaced less frequently.

Moreover, the pressure exchanger as choke device has an added benefit as compared to a traditional choke in that it is fail-safe. Typically, a choke actively moves a component such as a plug or needle into a seat in order to shut off. In case of a mechanical failure or large piece of debris inhibiting such movement, the valve cannot close or operate properly. This extra flow can pose a safety concern as undesirable flow or pressure occurs downstream of the valve. The pressure exchanger as choke has only a single moving part, the rotor. The rotor spins to allow flow. In the case of any failure that prevents rotation, the flow through the valve would stop. Thus, the valve could be safer to operate than a typical choke device since the pressure exchanger as choke includes an inherent fail-safe operation.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A method for using a pressure exchanger to reduce flow as a choke, comprising:

receiving a flow of a fluid under a first pressure at an inlet port of the pressure exchanger, wherein the pressure exchanger comprises a rotational element comprising a plurality of chambers that rotates about an axis;

filling a chamber of the plurality of chambers of the pressure exchanger with first pressure fluid;

rotating the rotational element of the pressure exchanger to an outlet position; and discharging a portion of the fluid in the chamber at a second pressure from an outlet port of the pressure exchanger, wherein the first pressure is higher than the second pressure; and wherein the pressure exchanger comprises at least one blocked port that is blocked through a complete rotation of the rotational element.

2. The method of claim 1, wherein receiving the flow of the fluid under the first pressure and discharging the portion of the fluid occur on a common end of the pressure exchanger.

3. The method of claim 1, wherein receiving the flow of the fluid under the first pressure and discharging the portion of the fluid occur at opposite ends of the pressure exchanger.

4. The method of claim 1 comprising adjusting a rate of discharge of the portion of the fluid by inserting an elastic object into the chamber.

5. The method of claim 1 comprising adjusting a rate of discharge of the portion of the fluid by adjusting a speed of the rotation of the chamber.

6. The method of claim 5, wherein adjusting the speed of the rotation of the chamber comprises at least partially driving a cylinder enclosing a plurality of chambers using a motor.

7. The method of claim 6, wherein using the motor comprises driving the motor electrically, hydraulically, or combustively driving the motor.

8. The method of claim 1 comprising rotating a cylinder comprising the chamber at least partially based on discharging the portion of the fluid.

9. The method of claim 1, wherein a rate of discharging the portion of the fluid is based at least in part a volume of the chamber, a number of chambers, properties of the fluid, and differential pressure of the high pressure fluid under the first pressure and a pressure of the discharged fluid.

10. The method of claim 9, wherein the properties of the fluid comprises a compressibility of the fluid.

11. A choke system comprising:

a pressure exchanger comprising:

an inlet port configured to receive fluid under a first pressure;

an outlet port configured to output the fluid under a second pressure, wherein the first pressure is higher than the second pressure;

a rotational element comprising a plurality of chambers that rotates about an axis, wherein the chambers move through a plurality of positions during a rotation of rotational element, wherein the plurality of positions comprise:

an inlet position where a respective chamber of the plurality of chambers is configured to receive the fluid under the higher pressure from the inlet port; and an outlet position where the respective chamber of the plurality of chambers is configured to output the fluid under the lower pressure to the outlet port; and wherein the pressure exchanger comprises at least one blocked port that is blocked through a complete rotation of the rotational element.

12. The choke system of claim 11 comprising a motor coupled to the rotational element of the pressure exchange configured to urge rotation of the rotational element, wherein a speed of the rotation is at least partially controlled by the motor, and flow of fluid through the choke system is at least partially based on the speed of rotation.

13. The choke system of claim 12, wherein the motor comprises an electric motor, a hydraulic motor, or a combustion engine.

14. The choke system of claim 11 comprising a plate that blocks the at least one blocked port of the plurality of chambers through the complete rotation of the rotational element.

15. The choke system of claim 14, wherein the inlet port and the outlet port are on a first end of the rotational element.

16. The choke system of claim 15, wherein the plate is located at a second end of the rotational element opposite of the first end.

17. The choke system of claim 11, wherein the inlet port and the outlet port are located on opposing ends of the rotational element.

18. The choke system of claim 11 comprising an elastic element disposed in at least one of the plurality of chambers to simulate increased compressibility of the fluid to increase a flow rate of the fluid through the pressure exchanger.

19. The choke system of claim 11, wherein at least one chamber of the plurality of chambers is angled, curved, of both.

20. A choke system comprising:

a pressure exchanger comprising:

an inlet port configured to receive fluid under a first pressure;

an outlet port configured to output the fluid under a second pressure, wherein the first pressure is higher than the second pressure;

a rotational element comprising a plurality of chambers that rotates about an axis, wherein the chambers move through a plurality of positions during a rotation of rotational element, wherein the plurality of positions comprise:

an inlet position where a respective chamber of the plurality of chambers is configured to receive the fluid under the higher pressure from the inlet port; and an outlet position where the respective chamber of the plurality of chambers is configured to output the fluid under the lower pressure to the outlet port; and an elastic element disposed in at least one of the plurality of chambers to simulate increased compressibility of the fluid to increase a flow rate of the fluid through the pressure exchanger.

* * * * *